United States Patent [19]

Evanyk

[11] Patent Number: 5,033,212

[45] Date of Patent: Jul. 23, 1991

[54] SYSTEM FOR INCREASING THE VISIBILITY OF AN OBJECT

[76] Inventor: Walter R. Evanyk, 3200 Sherrye Dr., Plano, Tex. 75074

[21] Appl. No.: 594,010

[22] Filed: Oct. 9, 1990

[51] Int. Cl.[5] ..... A43B 23/00

[52] U.S. Cl. ..... 36/137; 36/139; 362/103

[58] Field of Search ..... 36/137, 139; 362/103

[56] References Cited

U.S. PATENT DOCUMENTS

| | | | |
|---|---|---|---|
| 4,128,861 | 12/1978 | Pelengaris | 36/137 X |
| 4,158,922 | 6/1979 | Dana, III | 36/137 |
| 4,780,968 | 11/1988 | Bragagnolo | 36/2.6 |
| 4,798,933 | 1/1989 | Annovi | 36/2.6 X |
| 4,812,953 | 3/1989 | Ask et al. | 362/103 |
| 4,848,009 | 7/1989 | Rodgers | 36/137 |
| 4,935,851 | 6/1990 | Wood | 362/103 |

FOREIGN PATENT DOCUMENTS 0121026 10/1984 European Pat. Off. ..... 36/137

*Primary Examiner*—Jimmy G. Foster
*Assistant Examiner*—BethAnne Cicconi
*Attorney, Agent, or Firm*—Jones, Day, Reavis & Pogue

[57] ABSTRACT

High-intensity LEDs are mountd on or form part of an object to be illuminated. The object has first electrical terminals thereon that are coupled to the LEDs. A portable electrical circuit having second terminals for detachable coupling to the first terminals on the object causes the LED to flash and provide visibility to the object. The electrical circuit is contained in a package that has a first Velcro strip thereon. A second Velcro strip is mounted on the object near the first terminals so that the electrical circuit can be attached thereto by the Velcro strips and the electrical terminals coupled together.

13 Claims, 1 Drawing Sheet

SYSTEM FOR INCREASING THE VISIBILITY OF AN OBJECT

FIELD OF THE INVENTION

The present invention relates in general to a system for increasing the visibility of an object and in particular to a jogging shoe comprising at least one miniaturized light-emitting diode embedded in the body of the shoe, electrical contacts externally mounted on the shoe and coupled to the LED and an electrical circuit for removable coupling to the LED through the externally mounted contacts causing the LED to be selectively illuminated.

BACKGROUND OF THE INVENTION

The need for making objects more visible to adjacent observers grows increasingly with the increased numbers of joggers, hikers, runners, pets, scuba divers and the like.

Joggers, hikers and runners have for some time worn light-colored clothing, reflective devices or lights to identify their presence. Problems arise with these approaches due to limited range of visibility, battery life and the size of the devices. Further, individuals have always used some technique for locating or knowing where their pet is with items such as bells, clothing, reflective items, lights and transmitters. Again, these approaches have problems due to limited range, battery life and energy requirements. Further, current devices for floating and diver location have either incandescent or strobe high-intensity lights. These devices all share problems such as battery life, weight, visibility under water, user annoyance, primarily white-light output and the like.

The present invention overcomes these disadvantages by supplying high-intensity LEDs as part of the object to be illuminated. The object to be illuminated also has first electrical terminals coupled to the LEDs mounted thereon. An electrical circuit having second electrical terminals for detachable coupling to the first terminals on the object causes the LED to flash and provide visibility to the object. The electrical circuit may be mounted in a package or container that has a first strip of a trademarked product known as Velcro thereon. A second Velcro strip is mounted on the object near to or adjacent the first terminals thereon and the electrical circuit package may then be mounted to the object by the first and second Velcro strips with the first and second terminals connected to each other to supply power to the LED and cause it to flash or otherwise be illuminated. The electrical circuit may advantageously be a unitary kit having a power supply and a flashing circuit selectively coupled to the power supply such that when the first terminals are connected to the second terminals, the LED is caused to flash.

By providing one or more high intensity LEDs in the sole of an athletic shoe, the simple addition of the electrical circuit to each of the shoes allows the high intensity LEDs to pulse to issue observable flashes. The LEDs could be placed, for example, in the sole of the shoe with the wires running to the first terminals near a Velcro strip also attached to the shoe in an advantageous or convenient location. The electrical circuit could then be attached to the shoe by means of the Velcro strips and the first and second terminals connected to activate the LEDs. If it is desired to use the shoes without the LEDs being illuminated, as for example in the daytime, the detachable electrical circuit simply need not be placed on the shoes or, if placed on the shoes, the terminals need not be connected. Divers could use the high intensity LEDs mounted in a strap around their wrist, for example. Again, the battery pack would be watertight and the connections between the battery pack and the LED circuits would also be watertight to prevent electrical circuit malfunction. Further, a simple arm band with multiple high intensity LEDs simultaneously flashing could be used to locate or call attention to joggers, hikers and runners. The strap may be elastic with Velcro ends and contain LEDs spaced on three sides of the arm. Alternate locations can be the leg, ankle, or head. Again, the LEDs and electrical wiring with their respective terminals would be formed as a part of the strap. The electrical flashing circuit would be self-contained with a piece of Velcro thereon and second terminals so that it could be stuck to the arm, head, leg or ankle band and the second terminals connected to the first terminals in order to power the circuit. In like manner, a simple attractive main or secondary collar could be used for an animal. The collar may have multiple high intensity LEDs simultaneously or alternately flashing. They would be constructed again with the LEDs and the electrical covering, including terminals, in the collar itself with a strip of Velcro for attaching a housing including a power supply and flashing control circuit. The housing has terminals to be matched with the collar terminals.

Thus, it is an object of the present invention to provide a system for increasing the visibility of an object.

It is also an object of the present invention to increase the visibility of an object by providing at least one LED forming a permanent part of the object with first electrical terminals on the object for coupling power to the LED and an electrical control circuit having second terminals for detachable coupling to the first terminals for causing the LED to flash and provide visibility to the object.

It is still another object of the present invention to provide a Velcro strip mounted on the object adjacent the first terminals and a mating Velcro strip mounted on the electrical control circuit for enabling the electrical circuit to be removably attached to the object.

It is yet another object of the present invention to provide an electrical control circuit for causing an LED to flash that is in the form of a unitary housing having a power supply and a flashing circuit selectively coupled to the power supply such that when the first terminals are connected to the second terminals, the LED is caused to flash.

It is also an important object of the present invention to provide a jogging shoe which has at least one miniaturized light-emitting diode embedded in the body of the shoe with contacts externally mounted on the shoe and coupled to the LED. An electrical circuit is removably attached to the shoe and electrically coupled to the LED through the externally mounted contacts to cause the LED to be selectively illuminated.

It is still another object of the present invention to provide a portable, detachable electrical control circuit that can be removably attached to an object having an LED forming part thereof such as athletic shoes, arm bands, leg bands, marine locators, and pet locators.

SUMMARY OF THE INVENTION

Thus, the present invention relates to a system for increasing the visibility of an object comprising at least one LED forming a permanent part of the object, first electrical terminals on the object for coupling power to the LED and a control circuit detachably coupled to the object and having second terminals for detachable coupling to the first terminals for causing the LED to flash selectively and provide visibility to the object.

It is also an object of the present invention to provide a jogging shoe comprising at least one miniaturized light-emitting diode embedded in the body of the shoe, electrical contacts externally mounted on the shoe and coupled to the LED and an electrical control circuit detachably coupled to the shoe for coupling to the LED through the externally mounted contacts to cause the LED to be selectively illuminated.

BRIEF DESCRIPTION OF THE DRAWINGS

These and other objects of the present invention will be more fully understood in conjunction with the following detailed specification taken in conjunction with the attached drawings in which like numerals represent like components and in which.

DETAILED DESCRIPTION OF THE DRAWINGS

Figure 1:
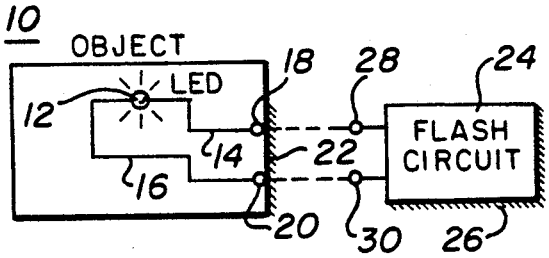
FIG. 1 is a block diagram representing an object having an LED and circuitry formed as a part thereof and having external electrical terminals and a connecting device such as a Velcro strip, and a portable flashing circuit in a kit form with a matching Velcro strip, the kit having external terminals for coupling to the terminals on the object to cause the LED to be selectively illuminated.

FIG. 1 is a diagrammatic representation of an object 10 having an LED 12 forming a part thereof and being coupled to electrical conductors 14 and 16 forming part of object 10 and coupled to first terminals 18 and 20, respectively, also forming part of the object to be observed. A strip of material known by the trademark Velcro 22 is advantageously fastened to the object 10 at a point adjacent the first terminals 18 and 20 for receiving a flashing control circuit 24 which also has a matching Velcro strip 26 and second electrical terminals 28 and 30 for matching contact with the first terminals 18 and 20 respectively.

Figure 2:
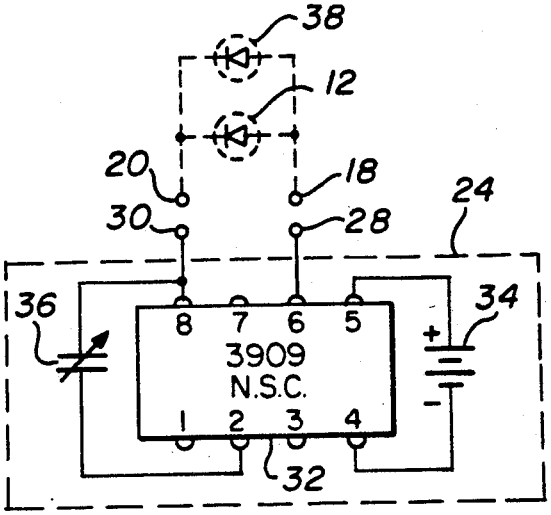
FIG. 2 is a circuit illustrating the use of a semiconductor chip in a control circuit to provide the flashing circuit and illustrating the connections thereon.

FIG. 2 is an electrical diagram of a flashing control circuit 24 that could be used in the circuit of FIG. 1. Circuit 24 utilizes a semiconductor chip 32 that is of the type designated 3909 and manufactured by National Semiconductor. It has a battery 34 coupled to terminals 4 and 5 thereof for powering the device and a capacitor 36 which can be varied to change the frequency of the output signals on terminals 28 and 30. The terminals 28 and 30 may be coupled to terminals 18 and 20 respectively that are coupled to a high intensity LED 12, as illustrated in FIG. 1, where the LED 12 is a part of the object to be detected. Additionally, if desired, further LEDs such as LED 38 may be coupled in parallel with LED 12.

Figure 3:
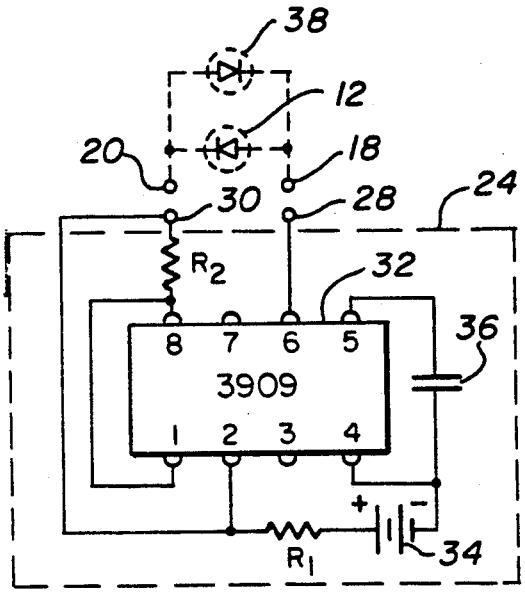
FIG. 3 is a circuit diagram of an alternate control circuit using a semiconductor chip to cause first and second LEDs to be alternately illuminated.

In FIG. 3, an alternate control circuit is illustrated wherein the portable electrical kit 24 contains the flashing circuit therein and is coupled to high intensity LEDs 12 and 38 coupled in parallel to terminals 18 and 20. If the polarity of the LEDs are reversed when in parallel such as that shown, the result would be alternate strobing instead of simultaneous strobing of the LEDs. Some of the high intensity LEDs 12 and 38 that are available in the art are designated MT5000UR and Sharp LT-9512U. These LEDs emit visible and invisible energies. For certain applications, the LEDs 12 and 38 could be chosen to emit only infrared rays which are invisible to the human eye.

Figure 4:
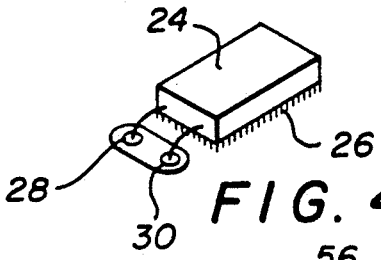
FIG. 4 is a diagrammatic representation of a flasher kit electrical circuit having external terminals and a Velcro strip thereon for selective attachment to an electrical circuit on an object having an LED.

In the circuit illustrated in both FIGS. 2 and 3, the integrated circuit 32 is a National Semiconductor 3909 or equivalent, such as a timer designated in the art as a 555 timer. The integrated circuit 32 operates as a relaxation oscillator flashing the LEDs 12 and 38 sequentially. Capacitor 36 is the timing and storage capacitor. It alternately charges through the LEDs 12 and 38 and is discharged through an internal resistor of the integrated circuit 32. Resistors R1 and R2 in FIG. 3 serve as current limiting resistors and permit operation above 3 volts DC. The integrated circuit 32 supplies a voltage of high current through the LEDs 12 and 38 via internal resistors with current gain up to 1,000. In voltage applications above 3 volts, the fast RC circuit, pin 1 of integrated circuit 32, is normally connected to the slow RC circuit, pin 8, and the timing capacitor 36 is coupled to pins 4 and 5. In the circuit in FIG. 2, the capacitor 36 serves both as a timing element and voltage booster. In both FIGS. 2 and 3, the anodes of the LEDs 12 and 38 can be directly connected to pin 5 in lieu of pin 6, thus bypassing an internal 12 ohm current limiting resistor. Thus, the LEDs 12 and 38 in that case will have a brighter intensity because more current will be supplied to the LEDs. Each of the circuits 24 can be simple sealed modules such as that shown in FIG. 4 having a Velcro strip 26 attached thereto that can be attachable to other Velcro strips on articles, vehicles, and individuals. It also has contacts 28 and 30 that can be removably attached to the LED contacts on an object. It could also be attached to animals via numerous means such as collars and the like. The circuit could also be manufactured into items such as, but not limited to, watches, watch bands, shoes, straps or belts for an individual or animals or formed in a sealed container for marine applications such as used by divers or placed on equipment for locating underwater objects and the like.

The advantages of the circuits illustrated in FIGS. 1, 2 and 3 are they are portable and very small, have extremely long battery life, have durability over other light sources, can operate with very low voltages, produce multiple and selectable energy outputs (visible-invisible light), can be observed at great distances, and in marine applications such as diving or underwater operations, they can carry longer distances largely due to freedom from absorption of incandescent or strobe energies by moisture which can create a small fog envelope of light around the light-emitting source. This often blinds the user or interferes with photographic operations.

Figure 6:
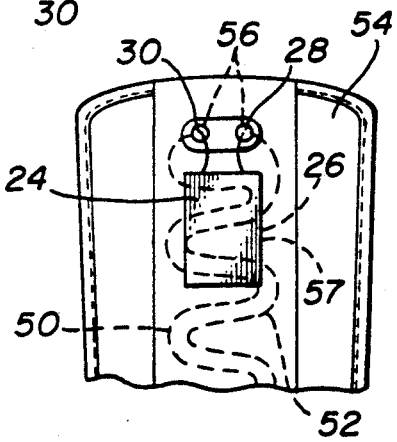
FIG. 6 illustrates the electrical wiring passing up through the tongue of the shoe in a serpentine "S" shaped fashion to protect the wiring from undue strain when the user is jogging.
Figure 5:
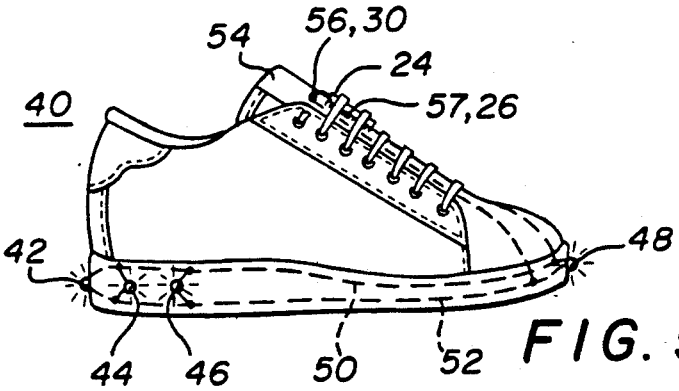
FIG. 5 is a diagrammatic representation of an athletic shoe having LEDs embedded in the sole thereof and on the toe thereof and having electrical wiring in the sole of the shoe and up through the tongue of the shoe to external terminals adjacent a Velcro strip to which is attached a removable electronic flashing circuit.

FIG. 5 is a schematic representation of a jogging shoe 40 having LEDs 42, 44, 46 and 48 embedded in various locations in the sole thereof. Coupled to the LEDs is an electrical wiring circuit including conductors 50 and 52 that are embedded in the sole and run up along the tongue 54 of the shoe 40 to external terminals 56. All of the wiring 50–52 is embedded in the shoe during construction thereof. The shoe has a Velcro strip 57 on the tongue 54 thereof adjacent the electrical contacts 56. Portable electric pack 24, such as that illustrated in FIGS. 1, 2, 3 and 4, is selectively attached to the Velcro strip 57 and its terminals 28 and 30 (shown in FIG. 6) coupled to the terminals 56 to cause the LEDs 42, 44, 46 and 48 to be selectively illuminated. The conductors 50 and 52 may be wound up the tongue 54 of shoe 40 in a serpentine fashion as illustrated in FIG. 6 to protect the conductors from being stressed or elongated during jogging by the person wearing the shoes 40. More or less LEDs may be placed on the shoe as desired.

Figure 7:
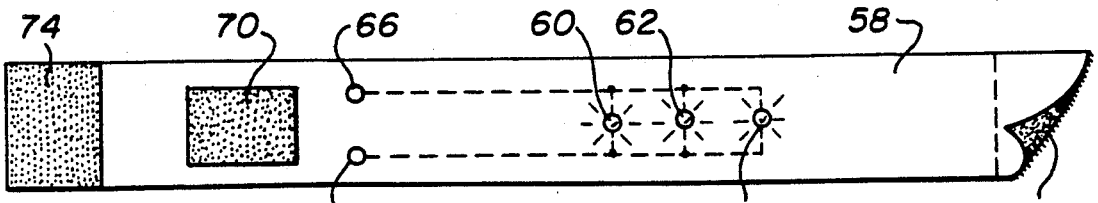
FIG. 7 is a diagrammatic illustration of an arm band, head band, leg band, ankle band or collar having multiple LEDs thereon and forming part thereof and illustrating a Velcro strip adjacent externally mounted terminals that are coupled to the LEDs for receiving a power supply and control circuit kit to be coupled to the terminals to illuminate the diodes.

FIG. 7 illustrates a strap 58 which may have LEDs 60, 62 and 64 embedded therein and coupled electrically in parallel to terminals 66 and 68. Velcro strip 70 is formed on the strap 58 adjacent to terminals 66 and 68 so that the portable flashing unit shown in FIG. 4 can be attached thereto as explained previously. Ends 72 and 74 of strap 58 may also have mating Velcro strips thereon for convenient fastening.

Thus, there has been disclosed a system for increasing the visibility of an object by providing an LED as a permanent part of the object with first electrical terminals coupled to the LEDs for supplying power thereto and a portable electrical flashing circuit in the form of a kit that can be a sealed module attachable to the objects to be made highly visible causing the high intensity LEDs to pulse to issue warning or identification.

The LEDs and the wiring may be found in the sole or sides or tongue of a shoe, on arm bands, leg bands, marine locators, locator bands for pets and the like.

To prevent battery drain when portable electric pack is not connected to the LED, extra terminals (not shown) could be used with the kit terminals and the shoe terminals to connect and disconnect the battery from the circuit chip. Also, a switch (not shown) could be inserted in the battery lead and project externally from the kit or portable pack to be manually operated to connect and disconnect the battery from the circuit chip and prevent drain on the battery when the circuit is not in use.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. A jogging shoe comprising:

at least one miniaturized light-emitting diode embedded in the body of the shoe;

first electrical contacts externally mounted on said shoe and coupled to said LED; and a portable kit having a complete electrical control circuit contained therein for removable coupling to said shoe and having second contacts thereon for coupling to said LED through said externally mounted first contacts to cause said LED to be selectively illuminated by said circuit.

2. A shoe as in claim 1 wherein said electrical circuit comprises:

an integrated circuit for coupling to the LED through said first and second contacts to cause the LED to flash; and a battery coupled to the integrated circuit for providing power to the electrical circuit.

3. A shoe as in claim 2 wherein the LED and the coupling for the electrical contacts on said shoe are formed internally of a shoe portion during the manufacture of the shoe, and the first electrical contacts are mounted on the tongue of the shoe.

4. A shoe as in claim 3 wherein said portable kit comprises:

a sealed module formed as a unitary package including said battery and said integrated circuit; and said second contacts forming part of the unitary package and connected to the battery and integrated circuit in the package, said second contacts being arranged to mate with the first externally mounted contacts to cause the LED to flash.

5. A shoe as in claim 4 wherein said unitary package includes:

a container;

said battery and integrated circuit mounted in the container;

said second contacts extending from said container so as to be easily mated with said shoe external contacts;

a first Velcro strip mounted on said shoe adjacent said external contacts; and a second mating Velcro strip mounted on the container for enabling the unitary package to be securely attached to the first Velcro strip on said shoe to enable selective mating of said shoe external contacts to said second contacts extending from said container.

6. A shoe as in claim 1 further comprising:

a first LED protruding from the rear of the shoe heel;

a second LED protruding from at least one side of the shoe heel; and a third LED protruding from the toe of the shoe sole.

7. A shoe as in claim 6 further comprising a pair of conductors connecting said LEDs to said external shoe contacts, said conductors being formed internally of a shoe portion in the shape of a continuous "S" to reduce stress on the conductors when the shoe flexes during use.

8. A system for increasing the detachability of an object comprising:

at least one LED forming a permanent part of the object;

first electrical terminals on the object for coupling power to the LED; and a unitary portable electrical control circuit for removable attachment to the object and having second terminals for detachably coupling to the first terminals to cause the LED to flash and provide visibility to the object.

9. A system as in claim 8 further comprising:

a Velcro strip mounted on the object adjacent to first terminals; and a mating Velcro strip mounted on the electrical circuit for enabling the electric circuit to be removably attached to the object.

10. A system as in claim 9 wherein said electrical circuit comprises:

a unitary kit having a power supply and a flashing circuit; and said flashing circuit being selectively coupled to the power supply and the LED such that when the first terminals are connected to the second terminals the LED is caused to flash.

11. A system as in claim 10 further comprising means coupling multiple LEDs to the flashing circuit such that alternate LEDs are flashed sequentially.

12. A system as in claim 11 further including means coupled to the flashing circuit for varying the flashing frequency of the LEDs.

13. A system as in claim 12 wherein at least some of the LEDs emit infrared rays that are invisible to the human eye.

* * * * *

UNITED STATES PATENT AND TRADEMARK OFFICE

CERTIFICATE OF CORRECTION

PATENT NO. : 5,033,212

DATED : July 23, 1991

INVENTOR(S) : Walter R. Evanyk

It is certified that error appears in the above-identified patent and that said Letters Patent is hereby corrected as shown below:

On the cover page, in the first line of the ABSTRACT, "mountd" should read --mounted--.

Column 4, line 1, after "strip" and before "of", insert --22--; and
line 2, delete "22".

IN THE CLAIMS:

CLAIM 8: column 6, line 65, delete "detachability" and replace with --detectability--; and
column 7, line 7, delete "visibility" and replace with --detectability--.

Signed and Sealed this

Third Day of August, 1993

Michael K. Kirk

MICHAEL K. KIRK

*Acting Commissioner of Patents and Trademarks*

*Attest:*

*Attesting Officer*